US005643530A

United States Patent [19]

Shingu et al.

[11] Patent Number: 5,643,530

[45] Date of Patent: Jul. 1, 1997

[54] NON-MAGNETIC HIGH MANGANESE CAST PRODUCT

[75] Inventors: Yoshiaki Shingu; Yasushi Ueda, both of Osaka, Japan

[73] Assignee: Kurimoto, Ltd., Japan

[21] Appl. No.: 501,765

[22] Filed: Jul. 13, 1995

Related U.S. Application Data

[63] Continuation of Ser. No. 242,346, May 13, 1994, abandoned.

[30] Foreign Application Priority Data

Jan. 7, 1994 [JP] Japan ..... 6-012102

[51] Int. Cl.[6] ..... C22C 38/58

[52] U.S. Cl. ..... 420/56; 420/73

[58] Field of Search ..... 420/56, 73

[56] References Cited

FOREIGN PATENT DOCUMENTS 57-210959 12/1982 Japan ..... 420/56

58-107477 6/1983 Japan ..... 420/56

*Primary Examiner*—Deborah Yee

*Attorney, Agent, or Firm*—Jones, Tullar & Cooper, P.C.

[57] ABSTRACT

The invention intends to develop a functional material provided with sufficient non-magnetism, strength and ductility. The material is a non-magnetic high manganese cast product composed of 0.2 to 0.03% C, not more than 1.0%. Si, 10 to 20% Mn, not more than 0.1% P, not more than 0.05% S, 15.0 to 20.0% Cr, 2.5 to 6.0% Ni and not more than 0.20% N, and is used in a state of as cast. In this non-magnetic high manganese cast product, a magnetic permeability in the state as cast is not more than 1.05, and the non-magnetic high manganese steel has mechanical properties such that a tensile strength is not less than 620N/mm$^2$, a proof strength is not less than 250N/mm$^2$, an elongation is not less than 40%, and a reduction of area is not less than 30%. The material is preferably applied to a complicated or large-sized product. In forming the product, because no plastic deformation is employed, there is no possibility of deterioration of magnetic permeability, and because no heat treatment is employed, no decarburized layer is formed, resulting in good machinability and easy finishing.

2 Claims, 2 Drawing Sheets

NON-MAGNETIC HIGH MANGANESE CAST PRODUCT

This is a continuation of application Ser. No. 08/242,346 filed on May 13, 1994, now abandoned.

BACKGROUND OF THE INVENTION

1. Field of the Invention

The present invention relates to a non-magnetic material having high strength and high ductility and, more particularly, to a non-magnetic high manganese cast product which is used in an "as cast" state.

2. Prior Art

In modern technology, various kinds of materials to be used in association with a strong magnetic field have been developed and, in particular, research and development of a non-magnetic materials not influenced by a magnetic field, are very popular. For example, for the purpose of expanding the applicable field of the non-magnetic material to various nuclear fusion reactor equipment, various parts for a magnetic levitation train (linear motor car) and parts for motors and/or transformers, the metallurgical research and development has been promoted widely in the aspects of components of such non-magnetic material as well as heat treatment thereof, and actually a large number of attempts have been heretofore proposed. Reviewing the history of conventional non-magnetic materials, it is understood that an austenitic stainless steel which had been most popularly used as a non-magnetic material has the following disadvantages. That is, in the austenite stainless steel, a large amount of expensive Ni is required and, moreover, transformation may be induced by cold working thereby precipitating a martensite, eventually resulting in a high possibility of deterioration of non-magnetism. Therefore, it is a recent trend that, in place of the mentioned austenitic stainless steel, a non-magnetic high manganese steel has been spotlighted in the art, and a large importance has been increasingly given to research and development of this non-magnetic high manganese steel.

The non-magnetic high manganese steel is advantageous from the economical viewpoint since the same austenitic phase as stainless steel is obtained by substituting any or all of the Ni contained in stainless steel for a cheap Mn and, furthermore, the obtained austenitic phase is stable without transformation induction incidental to cold working, and thus there is less possibility of deterioration occurring in the non-maganetism. On the other hand, the non-magnetic high manganese steel has a disadvantage in that machinability is difficult due to the high percentage of Mn content. To overcome this disadvantage, several attempts have been proposed to expand the applicable range of this material in various uses. An object of such a proposal is directed to improve the machinability of the non-magnetic high manganese steel without affecting or deteriorating its non-magnetism, in other words, to improve ductility for cold and hot rolling as well as to improve steel strength. The machinability as well as steel strength is one of the problems to be solved since this material is directed to be used as a structural material or part of a linear motor car and nuclear fusion reactor. For example, the Japanese Patent Publication (examined) No. 60-54374 discloses a method for producing a cold-rolled austenitic steel plate and steel strip comprising the steps of hot rolling a billet; cold rolling the hot-rolled billet at a rolling percentage of not less than 20%; and annealing the obtained steel at a temperature range of 800°to 1150° C.; the billet containing not more than 0.70% C, not more than 2.5% Si, 9 to 35% Mn, 0.5 to 19.0% Cr, not more than 8% Ni, not more than 0.5% N, not more than 2.0% Al, not more than 0.02% Ca, and the remaining part being composed of iron and unavoidable impuritres. In effect, this Patent Publication proposes a method for producing a steel plate and a steel strip the non-magnetism of which is not deteriorated even when the material is subject to plastic transformation, by defining the rolling and annealing conditions so as to improve stability of the austenitic phase.

The Japanese Patent Publication (examined) No. 60-31897 proposes a specifically deformed non-magnetic reinforcing steel bar the basic elements of which are 0.20 to 1.20% C, 0.10 to 2.0% Si, 5.0 to 35% Mn, 0.50 to 5.0% Ni and 0.20 to 3.0% V, and which contains one or two of not more than 3.0% Cu, not more than 5.0% Cr, not more than 3.0% Mo, not more than 2.0% Ti, not more than 1.0% Zr, not more than 0.30% N, not more than 2.0% Nb, and not more than 2.0% Al. That is, in the non-magnetic steel according to this proposal, the addition of a very small amount of element such as V and others is a required condition, and a hot working is an essential requirement for producing this deformed non-magnetic reinforcing steel bar. As a result of such a structure, it was reported that a deformed non-magnetic reinforcing steel bar of high strength and favorable shearing characteristic was obtained. Further, the Japanese Patent Publication (examined) No. 62-6632 discloses a non-magnetic high manganese steel of improved machinability by adding not only Bi but also Ni, Cr, Al, Nb, V, Ca and S. Furthermore, the Japanese Patent Publication (examined) No. 61-37953 discloses a non-magnetic high manganese steel basically composed of C, Si, Mn, Ni, Cr and N, and of which cold working characteristic and corrosion resistance are improved by hot rolling.

The mentioned non-magnetic high manganese steel according to the prior art intends to improve strength and machinability when used as a structural material, since the material is applied to be a guide way for a magnetic levitation train driven by a linear motor car, a reinforced concrete building for accommodating a nuclear fusion reactor, or a structural member for a generator (dynamo) as mentioned above. In such a conventional way of use, the structural member of non-magnetic high manganese steel incorporated in the mentioned facilities or equipment must be able to bear a heavy load, and to satisfy such a requirement, it is natural that the problem to be solved focusses on the strength and machinability improvement of the obtained non-magnetic steel. Furthermore, the non-magnetic high manganese steel is used to serve as a structural member, and the structural member is usually formed by plastic deformation. Hence there arise a difficult problem of how to prevent transformation induction and, for that purpose, a complicated relation among thermal conditions, restrictions on required components, etc. must be successfully coordinated.

It is, however, to be noted that the industrial field in which non-magnetic steel is used is not limited to the mentioned conventional structural members. Rather, there are now a lot of oppotunities in which non-magnetic steel is used as a functional material. Accordingly, it will be easily understood by persons skilled in the art that different kinds of problems to be solved may arise depending upon the different ways the steel is to be used, and with the progress of technological innovation, yet further problems to be solved may additionally arise.

It is required as a matter of course that, when a material is employed as a member operating under the influence of a strong magnetic field, the material must be a non-magnetic material in order to inhibit as much as possible the generation of heat due to generation of eddy current; in other words, the magnetic permeability μ must not be more than 1.05, and furthermore the non-magnetic material serving as a component or a member must have a material strength of a certain level. When further operating conditions are additionally required such that mentioned requirements or properties must be kept unvariable at any part of the member even if the member is large-sized and/or complicated or such that the shape of the member is so intricate that remaining parts which require finishing and/or machining work are difficult, the problems to be solved with regard to such large-sized or complicated non-magnetic material become considerably different from those incidental to the prior art.

For example, in order to prevent heat generation due to the generation of eddy current in the magnetic field, non-magnetic metal fittings such as high strength brass castings, stainless cast steel, etc., have been conventionally employed as a metallic member used for fixing an iron core of a generator. Under the background of recent increasing demand for large-sized generators, the metallic member for fixation of the iron core has been thickened to secure the required strength. There is, however, a restriction on such a thickening of the matallic member for fixation of the iron core due to restrictions on auxiliarly equipment attached to the generator. Non-magnetism is an essential requirement of the metallic member for fixation of the iron core as a matter of course, and furthermore, high strength is likewise required for fixation of the iron core, and high ductility is also required for thermal and mechanical strain of the fixed iron core. Particularly, in the case of a large-size generation, because an absolute quantity of strain tends to increase and become unexpectedly large, the high strength and high ductility of the metallic member for fixation of the iron core become very important properties. Moreover, if the metallic member is large-sized and formed into a complicated shape, a decarburized layer is unavoidably formed on the surface of the material when a solution heat treatment and a water toughening treatment peculiar to the non-magnetic high menganese steel are applied to the metallic member. As a result of this, an unavoidable deterioration of the magnetic permeability is brought about. This decarburized layer is usually removed after heat treatment. However, depending upon the shape of the metallic member, there may be a problem in that the decarburized layer can be neither ground nor machined.

SUMMARY OF THE INVENTION

The present invention was made to solve the above-discussed problems and has as an object providing a non-magnetic high manganese steel the material strength and ductility of which are largely improved while maintaining a magnetic permeability of sufficiently low level, and which is easily applicable even to a large and complicated member without heat treatment peculiar to high manganese steel.

To accomplish the foregoing object, a non-magnetic high manganese cast product according to the present invention contains 0.2 to 0.3% C, not more than 1.0% Si, 10 to 20% Mn, not more than 0.1% P, not more than 0.05% S, 15.0 to 20.0% Cr, 2.5 to 6.0% Ni, not more than 0.20% N, and the remaining part is composed of iron and unavoidable impurities, the non-magnetic high manganese cast product being used in an as cast state. From the viewpoint of more stable material characteristics, it is preferable that the mentioned elements are respectively defined to be in the range of 15 to 18% Mn, 16 to 18% Cr, 3.5 to 5.0% Ni, and 0.07 to 0.20% N. In the mentioned composition, it is most perferable that the magnetic permeability in the as cast state is not more than 1.05, and at the same time said cast product has a tensile strength of not less than 620 N/mm$^2$, a proof strength of not less than 250 N/mm$^2$, an elongation of not less than 40%, and a reduction of area of not less than 30%.

Since the non-magnetic high manganese steel according to the present invention is formed by casting, it is easy to form the non-magnetic steel into even a considerably complicated shape, in contrast to the conventinal formation by a forced plastic deformation such as drawing, rolling, extruding or forging. Since no plastic deformation is involved in the formation by casting, work hardening incidental to the conventional formation of non-magnetic high manganese steel does not take place and, as a result, machinability of the material after casting is favorably maintained. Further, the non-magnetic high manganese steel according to the present invention is characterized by not being subject to any heat treatment. More specifically, in the prior art, a solutuion heat treatment and a water toughening treatment have been applied without fail to the non-magnetic high manganese steel, just for the purpose of obtaining a structurally perfect austenitic phase. And these treatments are performed because of the importance of magnetic permeability and toughness. In this respect, it is to be noted that the non-magnetic steel according to the present invention is free from such troublesome treatments since the material is in an as cast state and is already possesed of non-magnetism and high toughness. As a result, a decarburized layer is not formed on the casting surface, whereby the process for removing a decarburized layer can be omitted. When forming a large-sized member of non-magnetic high manganese steel according to the prior art, usually it takes a long time for the required solution heat treatment and a thickening decarburized layer results. On the other hand, with the present invention, since the non-magnetic material is used in an as cast state, there is no such disadvantage as those incidental to the prior art, and even in case of a member of rather complicated shape, cracking problems due to uneven quenching at the time of a water toughening treatment do not arise.

From the viewpoint of the components, since any particular additive component is not required other resulting in less erroneous adjustment of components. For example, in the case of the afore-mentioned prior art (Japanese Patent Publication No. 60-54374), a certain amount of Al is added for the purpose of deoxidation in the last stage of melting when a high manganese cast steel is produced. Further, a small amount of Ca is originally contained in the raw material such as ferroalloy, and there is a still further possibility that Ca gets into the product from the refractory of the melting furnace. As it is reasonable to think that a certain ratio of these components existing in the molten metal may still remain in the metallic structure after solidification, it is uncertain that the non-magnetic material (containing a certain amount of unavoidably mixed components) according to the mentioned publication can perform significantly its function and technical advantage in a manner distinctive from other known non-magnetic materials. On the other hand, in the non-magnetic high manganese steel according to the present invention, the intended contents or numeric values can be sufficiently assured without depending upon any special additive components (other than Mn, Cr, N, Ni), being different from the prior art.

Reasons why each component is defined to be in the above percentage range are hereinafter described. In this regard, it is to be noted that the definition of the respective components discussed below is intensively decided on the basis of a series of systematic experiments to recognize how a blending ratio of each individual component or associated plural components corresponds to properties of the material intended by the present invention.

C is an element for stabilizing the austenitic phase and is an essential component of a high manganese non-magnetic material. If the content of C is not more than 0.2%, the proof strength is undesirably lowered. On the other hand, if the content of C exceeds 0.3%, elongation and area reduction are considerably decreased resulting in brittleness of the material. Therefore, to achieve the object of the present invention, it is defined that the lower limit of C is 0.2% and the upper limit is 0.3%.

Mn is also an element for stabilizing the austetic phase and, to obtain a non-magnetic material, at least 10% Mn (as the lower limit) is required. However, excessive Mn reduces castability and lowers tensile strength and proof strength, and therefore the upper limit is defined to be 20.0%. More preferably, Mn is defined to be in the range of 15 to 18% in view of the stable material characteristics.

Si is an element needed as a deoxidizer to maintain fluidity of the molten metal and improve castability. However, excessive Si reduces toughness and therefore the lower limit is defined to be not more than 1.0%.

Cr is an element effective for improving strength and corrosion resistance. However, excessive Cr forms a ferritic phase and increases magnetic permeability and therefore the upper limit is defined to be 20.0%. On the other hand, to stabilize the structure and secure the material strength in cooperation with C, Mn, Ni and N, a content of at least 15.0% Cr is essential. To obtain a material of more stable characteristic, it is preferable that Cr is defined to be in the range of 16 to 18%.

Ni is an element for stabilizing the austenitic phase. However, excessive Ni reduces the tensile strength and therefore the upper limit is defined to be 6.0%. On the other hand, to secure a sufficient non-magnetism, a content of at least 2.5% Ni is essential. Further, to obtain a material of more stable characteristic, it is preferable that Ni is defined to be in the range of 3.5 to 5%.

N is also an element for strongly stabilizing the austenitic phase and, at the same time, improving considerably the material characteristic. Generally, in high manganese steel, N gets into the product unavoidably from the raw material, i.e., ferro-manganese, ferro-chromium, etc., and also in the melting and casting in the atmosphere, 0.02 to 0.10% N gets into the product from the atmosphere. However, excessive addition often produces a large number of blowholes in normal static casting eventually resulting in defective casting, and therefore the upper limit is defined to be 0.2%. Also, to obtain a material of more stable characteristics, N is preferably defined to be in the range of 0.07 to 0.20%.

As the toughness of a welded part is significantly reduced if P is over 0.1%, this percentage is the upper limit of P.

S is transformed into MnS when Mn acts as a desulphurizer. However, a large content of S brings about an excessive inclusion of MnS thereby bringing about a reduction of ductility and a deterioration of the obtained material, and therefore the upper limit is defined to be 0.05%.

As mentioned above, the present invention provides a non-magnetic high manganese steel to which no particular additive component other than Mn, Cr, Ni and N is added, and therefore there is less influence by melting conditions. Since the formation of the material according to the present invention is performed by casting, even when a member of considerably complicated shape or large size is to be produced, a member of exact dimensions and without defect can be economically produced, as far as the casting plan is appropriately established. Since no plastic deformation is employed in the present invention, directional properties of crystal grain are less and, at the same time, there is no serious deviation depending upon the direction of the mechanical properties. The material according to the present invention is free from the problem of keeping a magnetic permeability low at the time of plastic deformation, and therefore free from delicate coordination of components as compared with the prior art. Since no heat treatment is applied in the present invention, there is less formation of a decarburized layer, and as a result, troublesome finishing and machining for the removal of the decarburized layer can be minimized. The value of magnetic permeability was actually found to be not less than 1.005 in all examples according to the present invention, which value is significantly low as compared with the range of 1.10 to 1.05 being a conventionally established standard. Furthermore, since the material according to the present invention is a cast product which does not require any heat treatment, there is an advantage of less restriction with respect to the thickness aspect of the product as compared with other non-magnetic materials. In effect, the above described technical advantages are superior by far to those achieved by the conventional non-magnetic high manganese steel.

Other objects, features and advantages of the present invention will become apparent in the course of the following description with reference to the accompanying drawings.

DESCRIPTION OF THE PREFERRED EMBODIMENT

Figure 2:
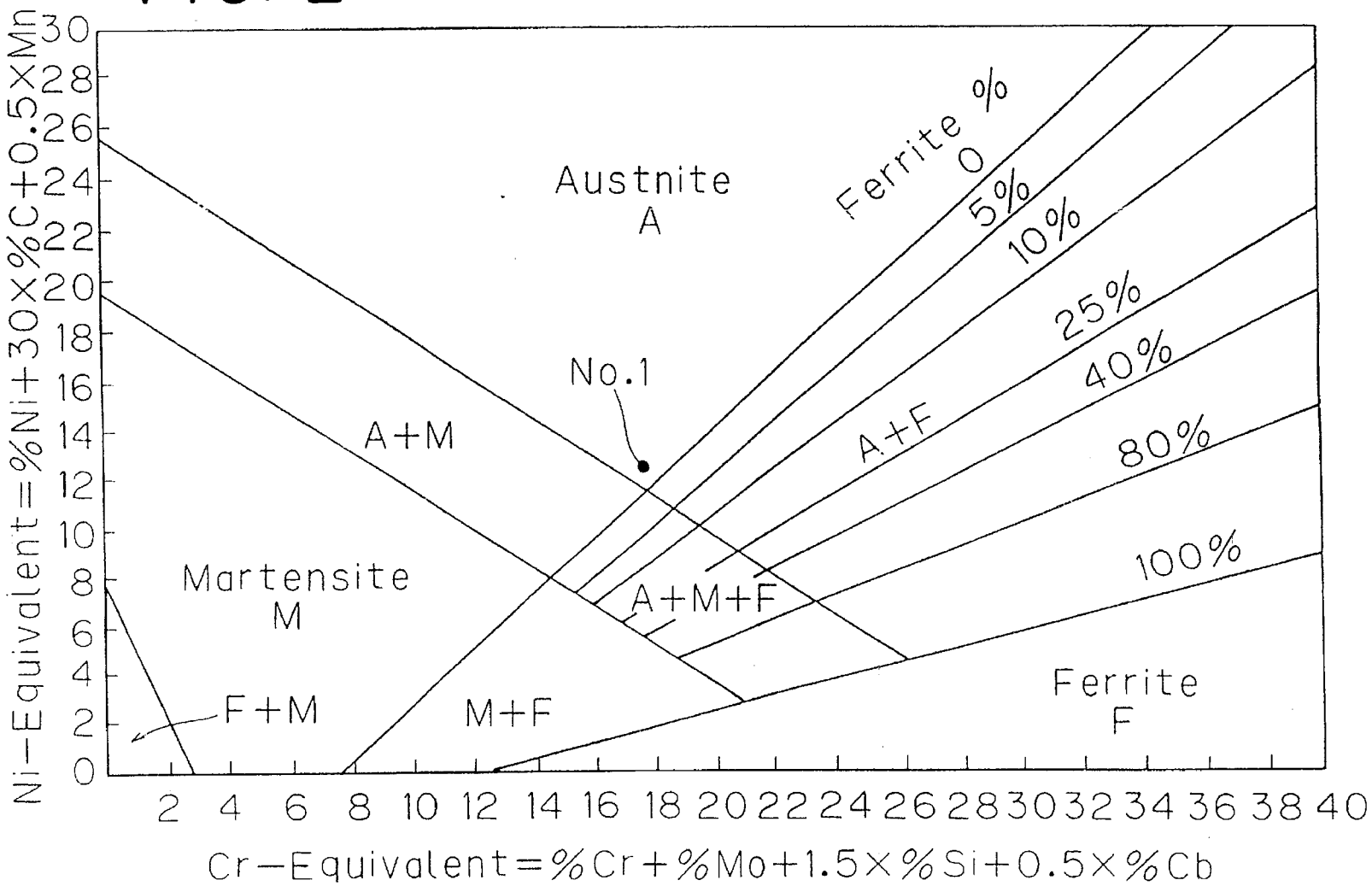
FIG. 2 is a graphic diagram prepared by writing the starting components of the invention on the Schaeffler's structural phase diagram.

FIG. 2 shows a so-called Schaeffler's structural phase diagram of a welded stainless steel, the abscissa of which indicates an equivalence of Cr, and the ordinate of which indicates an equivalence of Ni. This structural phase diagram is shown with respect to components of welded metal and does not always conform to the cast product of the invention. This invention adopts this phase diagram as a reference in reaching the present invention. The definition of the component range was established so as to obtain a non-magnetic material of not more than 1.05 in magnetic permeability and have also a high material strength. A range satisfying both of the mentioned two requirements of magnetic permeability and material strength was found out considering each individual effect of C, Mn, Ni, Cr, N as well as the united effect of these elements associated all together.

Describing the procedure performed up to the decision as to the ranges of respective components, first a material, No.1, corresponding to a bottom part of the stable austenic region in which even a very small variation in percentage of the elements brings about a significant change in structure in the Schaeffler's structural phase diagram, was selected as a basic material. Since this No.1 material belonged to a region of austenitic structure from the viewpoint of the Schaeffler's structural phase diagram, it was expected that the No.1 material was non-magnetic. As a result of actual measurement, however, a magnetic permeability of the No.1 material was found to be 1.350, which, contrary to expectations, was not worthy of a non-magnetic material. When inspecting the obtained structure microscopically, it was found that the structure was a mixture of the austenitic phase and the pearlitic phase. It is understood that this is because of a difference in that the present invention is directed to a cast product which is in an "as cast" state, while the Schaeffler's structural phase diagram is directed to a quenched product of stainless steel. Therefore, C, Mn, Ni, Cr and N were systematically increased or decreased to acknowledge a relation between magnetic permeability and variation of mechanical properties. Table 1, Table 2 and FIG. 1 respectively show the result of the acknowledged relation.

Then, considering that the values of a No.7 material were well-balanced and well-pointed, percentages of Mn, Ni and N were adjusted and thus a No.8 material completely satisfying the required characteristics was obtained. Further, a preferable component percentage of 0.25% C satisfying the requirements in association with other components was found as a No.9 material, and likewise a preferable component percentage of 0.30% was found as a No.10 material. On the other hand, when reducing the percentage of Cr, as shown in the No.2 and No.3 materials, a martensite was precipitated resulting in a decrease in ductility. As shown in No.4 and No.5, materials, the ductility was recovered by increasing the percentage of C, Mn and Ni to compensate for the decreased percentage of Cr, but there came out a tendency for strength reduction.

In conclusion, all of the required characteristics can be satisfactorily performed only by the No.7 to No.10 materials, being examples of which component range or percentage is defined by the present invention. On the contrary, in the comparative examples No.1 to No.6 being out of the defined component range, at least one of the required characteristics is deficient, which is a remarkable contrast between the preferred examples of the present invention and the comparative examples.

TABLE 1

| | C | Si | Mn | P | S | Cr | Ni | N | Cr Equivalent | Ni Equivalent |
|---|---|---|---|---|---|---|---|---|---|---|
| Comparative Examples | | | | | | | | | | |
| 1 | 0.13 | 0.52 | 11.1 | 0.032 | 0.003 | 16.9 | 2.48 | 0.039 | 17.7 | 11.9 |
| 2 | 0.14 | 0.39 | 11.6 | 0.020 | 0.001 | 11.8 | 2.50 | 0.034 | 12.4 | 12.5 |
| 3 | 0.20 | 0.42 | 12.0 | 0.026 | 0.002 | 12.0 | 2.52 | 0.042 | 12.6 | 14.5 |
| 4 | 0.21 | 0.43 | 18.4 | 0.025 | 0.002 | 11.8 | 4.50 | 0.046 | 12.4 | 20.0 |
| 5 | 0.30 | 0.49 | 18.0 | 0.040 | 0.002 | 11.9 | 4.64 | 0.047 | 12.6 | 22.6 |
| 6 | 0.38 | 0.54 | 11.2 | 0.046 | 0.004 | 17.1 | 2.60 | 0.081 | 17.9 | 19.6 |
| Examples | | | | | | | | | | |
| 7 | 0.20 | 0.48 | 11.7 | 0.022 | 0.003 | 17.4 | 2.55 | 0.074 | 18.1 | 14.4 |
| 8 | 0.20 | 0.46 | 15.3 | 0.027 | 0.004 | 17.6 | 3.72 | 0.196 | 18.3 | 17.4 |
| 9 | 0.25 | 0.48 | 17.6 | 0.035 | 0.001 | 16.3 | 4.61 | 0.087 | 17.0 | 20.9 |
| 10 | 0.30 | 0.38 | 15.6 | 0.035 | 0.001 | 18.0 | 3.25 | 0.033 | 18.6 | 20.1 |

TABLE 2

| | Tensile strength N/mm$^2$ | Proof strength N/mm$^2$ | Elongation % | Reduction of Area % | Magnetic Permeability μ | Structure |
|---|---|---|---|---|---|---|
| Comparative Examples | | | | | | |
| 1 | 681 | 258 | 24.3 | 18.5 | 1.350 | γ + P |
| 2 | 722 | 178 | 23.6 | 20.4 | 1.025 | γ + M |
| 3 | 665 | 239 | 23.2 | 21.2 | 1.002 | γ |
| 4 | 522 | 224 | 63.7 | 44.7 | 1.001 | γ |
| 5 | 542 | 256 | 41.4 | 29.9 | 1.001 | γ |
| 6 | 615 | 367 | 19.9 | 17.2 | 1.002 | γ + P |
| Examples | | | | | | |
| 7 | 657 | 287 | 45.0 | 39.5 | 1.003 | γ + P |
| 8 | 663 | 332 | 44.8 | 33.4 | 1.005 | γ |
| 9 | 630 | 296 | 53.0 | 43.7 | 1.003 | γ |
| 10 | 633 | 293 | 40.4 | 37.1 | 1.003 | γ + P |

γ:Austenite
P:Pearlite
M:Martensite

Figure 1:
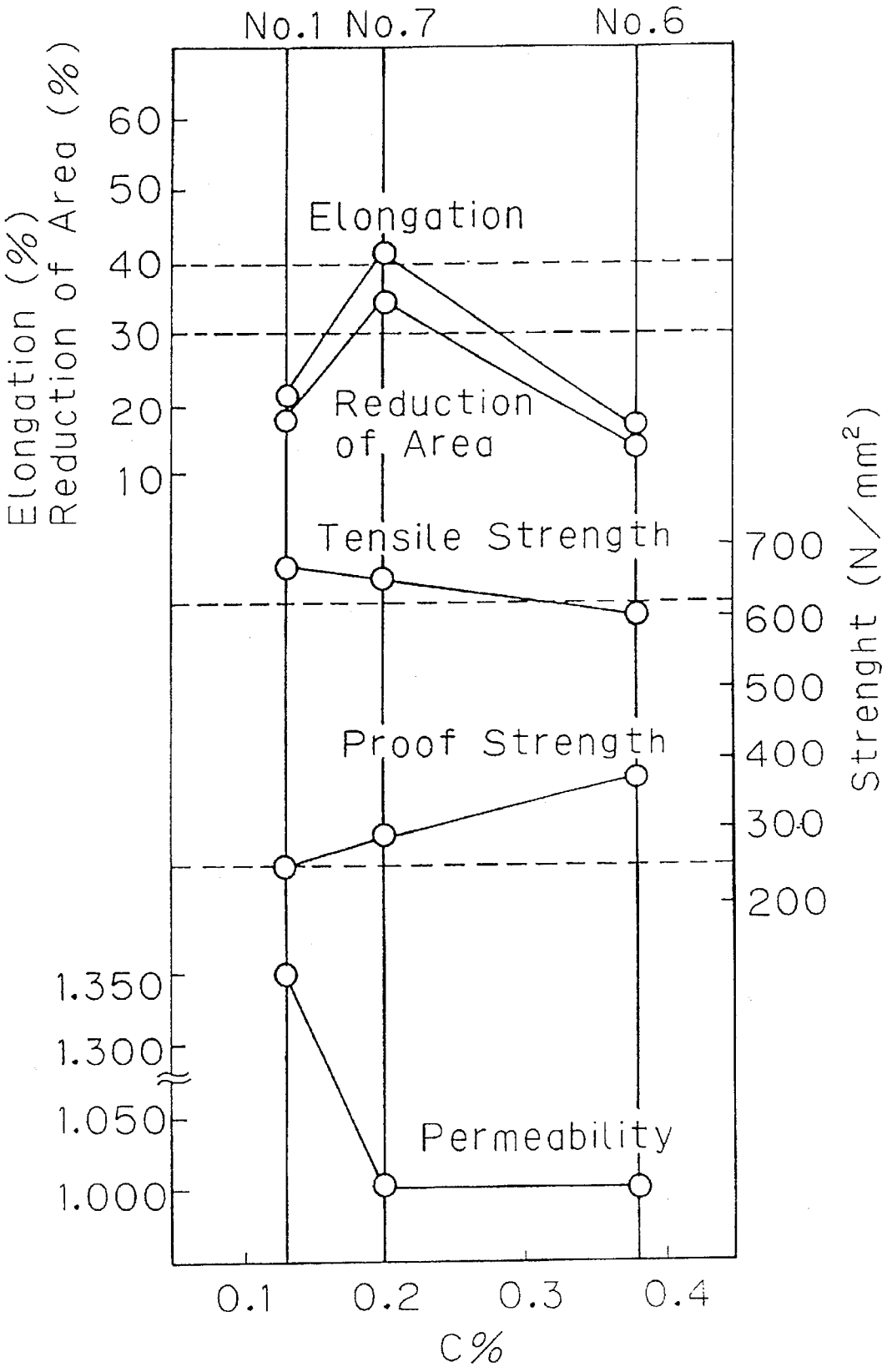
FIG. 1 is a graphic diagram showing a relation between an example according to the present invention and a comparative example with respect to mechanical properties, magnetic permeability and percentage of C.

Referring to FIG. 1, when increasing the percentage of C, the magnetic permeability was stabilized at a very low level and, at the same time, the proof strength was improved, while tensile strength was reduced. Elongation and area reduction were improved with the increase in the percentage of C, and when C had increased to about 0.2%, a material satisfying the mentioned two requirements was obtained. When increasing the percentage of C further, it was found that both elongation and area reduction were decreased.

What is claimed is:

1. A high manganese non-magnetic cast product containing 0.2 to 0.3%C, not more than 1.0% $S_i$, 11.0 to 18.0% $M_n$, not more than 0.1% P, not more than 0.05% S, 16.0 to 18.0% $C_r$, 2.5 to 6.0% $N_i$, not more than 0.20% N, and the remaining part composed of iron and unavoidable impurities, and without a decarburized layer, said high manganese non-magnetic cast product being used in an as cast state, wherein said cast product has a tensile strength of not less than 620 $N/mm^2$, a proof strength of not less than 250 $N/mm^2$, an elongation of not less than 40%, and a reduction of area of not less than 30%.

2. A high manganese non-magnetic cast product, containing 0.2 to 0.3%C, not more than 1.0% $S_i$, 11.0 to 18.0% $M_n$, not more than 0.1% P, not more than 0.05% S, 16.0 to 18.0% $C_r$, 2.5 to 6.0% $N_i$, not more than 0.20% N, and the remaining part composed of iron and unavoidable impurities, and without a decarburized layer, said high manganese non-magnetic cast product being used in an as cast state, with said magnetic permeability in the as cast state being not more than 1.05, wherein said cast product has a tensile strength of not less than 620 $N/mm^2$, a proof strength of not less than 250 $N/mm^2$, an elongation of not less than 40%, and a reduction of area of not less than 30%.

* * * * *